US005395461A

United States Patent [19]

Taki et al.

[11] Patent Number: 5,395,461

[45] Date of Patent: Mar. 7, 1995

[54] METHOD OF PRODUCING TITANIUM MATERIAL RESISTANT TO HYDROGEN ABSORPTION IN AQUEOUS HYDROGEN SULFIDE SOLUTION

[75] Inventors: Kazuhiro Taki, Atsugi; Akio Saito, Kawasaki, both of Japan

[73] Assignee: Nippon Mining & Metals Co., Ltd., Tokyo, Japan

[21] Appl. No.: 214,330

[22] Filed: Mar. 14, 1994

Related U.S. Application Data

[63] Continuation-in-part of Ser. No. 74,750, Jun. 10, 1993, abandoned.

[30] Foreign Application Priority Data

Jun. 18, 1992 [JP] Japan ..... 4-182896

[51] Int. Cl.[6] ..... C23C 8/54

[52] U.S. Cl. ..... 148/208; 148/316; 148/317; 148/278; 148/281; 134/3

[58] Field of Search ..... 148/208, 316, 317, 278, 148/281

[56] References Cited

U.S. PATENT DOCUMENTS 4,908,072 3/1990 Taki et al. ..... 148/316
5,051,140 9/1991 Mushiake et al. ..... 148/281

FOREIGN PATENT DOCUMENTS 53-12737 2/1978 Japan .
63-210286 8/1988 Japan .
3-243759 10/1991 Japan .

OTHER PUBLICATIONS

A. Z. Foroulis, "Corrosion and Hydrogen Embrittlement Behavior of Titanium in Aqueous Sulfidic Solutions", *Boshoku Gijutsu*, pp. 113–121 (1980).

L. C. Covington, "The Influence of Surface Condition and Environment on the Hydriding of Titanium", *National Association of Corrosion Engineers, pp. 378–382 (1979).*

Kazutoshi Shimogori et al., "Case Analyses of Hydrogen Absorption Embrittlement of Titanium Used in Practical Equipment", *Kobe Steel Engineering Reports* vol 35, No. 4, pp. 63–66 (1985).

*Primary Examiner*—Richard D. Dean
*Assistant Examiner*—Sean Vincent
*Attorney, Agent, or Firm*—Seidel, Gonda, Lavorgna & Monaco

[57] ABSTRACT

A method of producing a titanium material having enhanced resistance to hydrogen absorption in aqueous hydrogen sulfide solutions which comprises removing a layer of at least 0.5 μm depth from the surface of a titanium material that has been annealed after cold rolling so that titanium nitride, titanium carbide, or titanium carbonitride formed on the surface is removed. It is preferable that the titanium material has no flaw in the depth beyond 10 μm from the surface. It is desirable that the titanium material is polished so that it has a surface roughness Rmax not exceeding 3.0 μm. It is also preferred that the titanium surface has an oxide film ranging in thickness from 15 to 500 nm formed thereon.

8 Claims, 3 Drawing Sheets

METHOD OF PRODUCING TITANIUM MATERIAL RESISTANT TO HYDROGEN ABSORPTION IN AQUEOUS HYDROGEN SULFIDE SOLUTION

CROSS-REFERENCE TO RELATED APPLICATION

This application is a continuation-in-part of our application Ser. No. 08/074,750, filed Jun. 10, 1993, now abandoned.

FIELD OF THE INVENTION

This invention relates to a method of producing a titanium material which has excellent resistance to hydrogen absorption in an aqueous hydrogen sulfide solution.

BACKGROUND OF THE INVENTION

Titanium has outstanding resistance to corrosion, and is extensively used as an industrial material. For example, titanium is used in plants for the manufacture of chemicals, for power generation, and for the desalination of seawater. The high specific strength of titanium also makes it useful as a construction material for aircraft and the like.

The disadvantage of titanium is that it is prone to embrittlement with hydrogen absorption. When hydrogen molecules or atoms are present on its surface portion, titanium will readily absorb hydrogen to transform the titanium material into a brittle titanium hydride. As the amount of hydride formed increases, the titanium material becomes increasingly embrittled, which eventually causes it to rupture upon subjection to but a slight force. The environments that allow titanium to absorb hydrogen are, e.g., power plants where turbine blades are exposed to high-temperature steam or hot hydrogen gas.

Hydrogen absorption by titanium takes place in aqueous solutions too. This is attributed to the fact that, in the case of cathodic protection, galvanic corrosion, or the corrosion of titanium itself, a cathodic reaction $2H^{+}+2e^{-}\rightarrow H_2$ occurs on the titanium surface. The cathodic reaction causes a part of the resulting hydrogen to be taken up by titanium. Abundant literature exists on hydrogen absorption by titanium in such aqueous solutions. Methods already known for preventing it include, e.g., forming a thick titanium oxide film or a titanium nitride layer on the titanium surface.

A method of producing a titanium material for the purpose of providing excellent corrosion resistance in a aqueous acidic solution is described in U.S. Pat. No. 4,908,072 issued Mar. 13, 1990 to Taki, et al. A layer of at least one of titanium nitride, titanium carbide or titanium carbonitride is formed on the surface of a titanium material to provide corrosion resistance. The coated titanium materials were tested in an aqueous hydrogen chloride solution. Taki, et al. concluded that such titanium materials have a high resistance to corrosion in aqueous hydrochloric acid, sulfuric acid and nitric acid. Thus, Taki, et al. teach that one should form a layer of titanium nitride, titanium carbide, or titanium carbonitride on a titanium surface to provide an anticorrosive effect.

On the other hand, among aqueous solutions, little is known about hydrogen absorption by titanium in aqueous hydrogen sulfide solutions. The only literature available is the publication "CORROSION", Vol 35, No 8(1979), pp. 378–382. This publication, however, deals principally with the hydrogen absorption by titanium in contact with dissimilar metals in aqueous hydrogen sulfide solutions. It is totally silent as to the prevention of hydrogen absorption by titanium, when titanium is the only metal in contact with the aqueous hydrogen sulfide solution.

Oil refining plants must remove sulfur from crude oil and, to achieve the end, they add hydrogen to the oil and separate the sulfur in the form of hydrogen sulfide. The separated hydrogen sulfide flows through piping and the tubing of heat exchangers as an aqueous solution. We have found that when pure titanium alone, out of contact with any dissimilar metal, is immersed in such a solution, it undergoes vigorous hydrogen absorption. Solutions that contain hydrogen sulfide are generally so corrosive that ordinary metallic materials, such as copper alloys and stainless steels, are unable to withstand their attacks. One way of coping with these environments has been to use titanium that presents no corrosion problem, albeit there is the possibility of hydrogen absorption. Another alternative is to depend on much less expensive carbon steel for short-term service, with repeated replacements.

SUMMARY OF THE INVENTION

The present invention provides a method of producing a titanium material having improved resistance to hydrogen absorption in aqueous hydrogen sulfide solutions. The method comprises removing a layer of at least 0.5 μm deep from the surface of a titanium material that has been annealed after cold rolling so that titanium nitride, carbide, or carbonitride formed on the surface is removed. It is preferable that the titanium material has no flaws in the depth beyond 10 μm from the surface. It is desirable that the titanium material is polished so that it has a surface roughness Rmax not exceeding 3.0 μm. It is also preferred that the titanium surface has formed thereon an oxide film ranging in thickness from 15 to 500 nm.

Definitions

Figure 1:
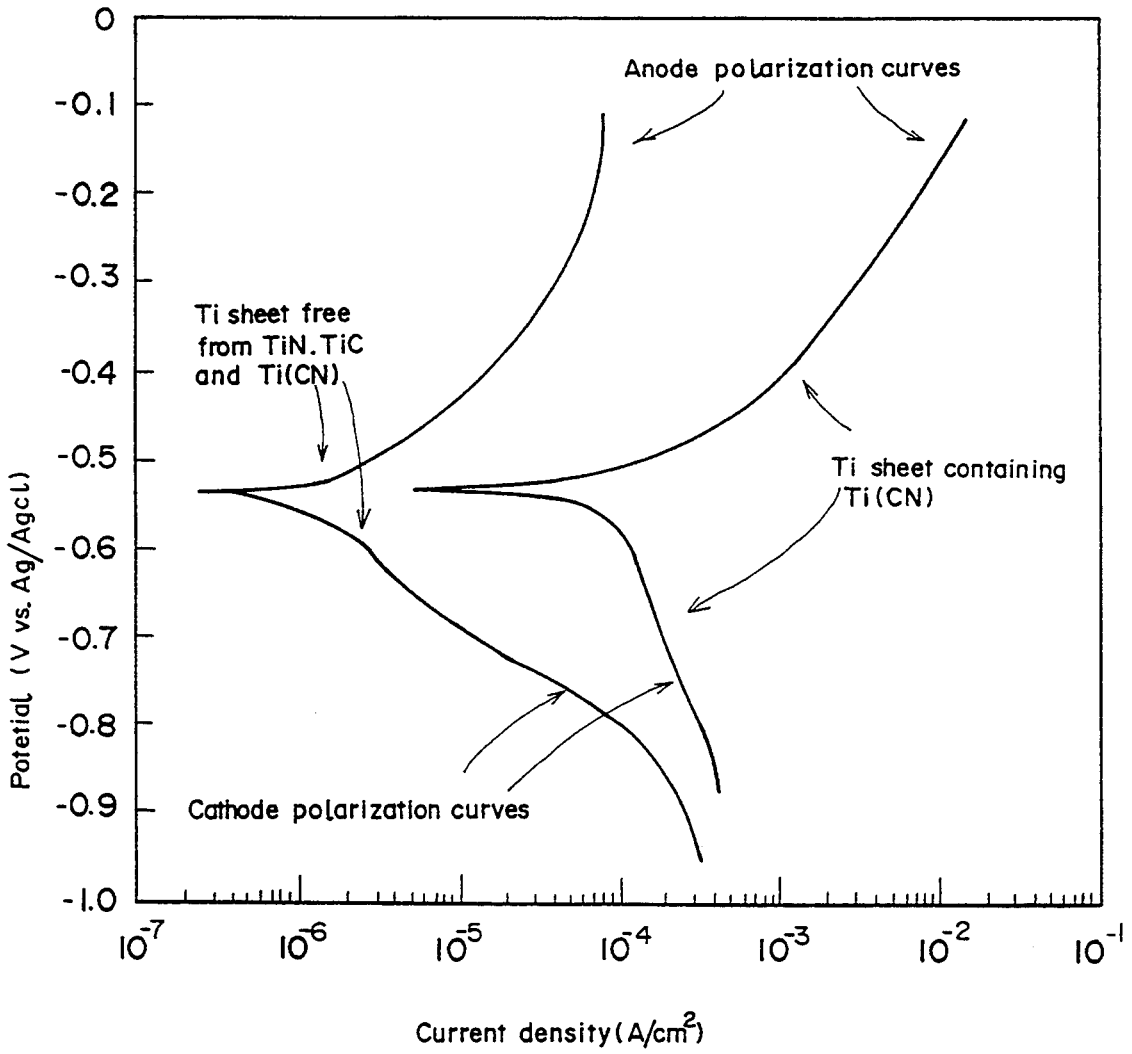
FIG. 1 is a graph showing the polarization behavior of titanium sheets in a hydrogen sulfide solution.

The term "titanium material" means a material made of titanium or of a titanium alloy, for example an α-type titanium alloy or a β-type titanium alloy.

The term "flaw" as regards the surface of a titanium material means a defect caused by a scratch, a scrape, an abrasion, a crack, a crevice, a cut, a jagged or rough indentation, or the like. Such a defect may be caused, for example, by handling or shipping the material or may be due to the removal of a portion of the surface.

DETAILED DESCRIPTION OF THE INVENTION

Titanium materials have been used in a variety of applications. It has been found in experiments, in actual oil refining, and in other similar applications, that when titanium materials are immersed in a high temperature aqueous hydrogen sulfide solution, a very violent hydrogen absorption sometimes occurs.

Titanium materials that are used in industrial plants like oil refineries are predominantly in the form of sheets and welded tubing. They are commonly made by cold rolling titanium with heat treatment, which can produce a layer of titanium nitride, titanium carbide, or titanium carbonitride on their surface. We have found that such materials are subject to embrittlement due to hydrogen absorption.

We have intensively studied ways to reduce hydrogen absorption by titanium in aqueous hydrogen sulfide solutions, and thereby extend the life of titanium. Our studies have led to the discovery that there is an important relationship between the surface conditions of titanium materials and the rate of hydrogen absorption. The present invention is predicated upon this discovery.

The present invention provides a method of producing a titanium material such as a sheet, coil, foil, etc. The method comprises removing a layer of at least 0.5 μm depth from the surface of a titanium material that has been annealed after cold rolling so that a layer of titanium nitride, carbide, or carbonitride is removed. The titanium material produced thereby has excellent resistance to hydrogen absorption in an aqueous sulfide solution.

Prior to the present invention it has been suggested in this field that a titanium material having a layer formed of at least one of titanium nitride, titanium carbide or titanium carbonitride on its surface has enhanced corrosion resistance. Such titanium materials may be produced by a number of commercial methods. A typical commercial process is the Taki, et al. process, as described in U.S. Pat. No. 4,908,072.

In the Taki process, a titanium material is subjected to cold working in the presence of an oil (rolling oil) during 10% or more of the total working reduction. The titanium material is then subjected to in-situ heat treatment at a temperature of at least 300° C. (for example 300° C. to 850° C.). This cold-rolling and heat treatment process forms a layer of at least one of titanium carbide, titanium nitride or titanium carbonitride on the titanium material surface. The layer is formed by reaction of the titanium material with nitrogen and/or carbon contained in the oil. The process permits efficient and effective production of titanium materials.

Taki, et al. tested titanium materials having surface layers of titanium carbide, nitride or carbonitride, and reported corrosion resistance in an aqueous hydrochloric acid solution. Taki, et al. also expected such materials to have corrosion resistance in other aqueous acidic solutions, such as sulfuric acid solutions and nitric acid solutions. Taki, et al. recommended that titanium materials with such a protective layer could be used in chemical plants or in places where gap corrosion is likely to occur. Hence, a titanium carbide, titanium nitride, or titanium carbonitride layer on the surface of a titanium material was generally believed to enhance corrosion resistance of titanium. Such a layer on a titanium surface is also believed effective in resisting hydrogen absorption, as suggested in Japanese Patent Application Public Disclosure Nos. 210286/1988 and 243759/1991. For these reasons, titanium parts having a coating of titanium carbide, nitride or carbonitride have been employed as they are, without removing the coating, in oil refining and other similar applications.

Surprisingly, we have discovered that such a surface layer does not provide corrosion resistance for titanium materials in an aqueous hydrogen sulfide solution environment. When a titanium material having a protective layer of titanium carbide, nitride or carbonitride is contacted with, or immersed in, an aqueous hydrogen sulfide solution, hydrogen absorption occurs, sometimes very violently. This absorption of hydrogen is surprising since such the surface layer is believed generally to enhance the corrosion resistance of titanium materials in an aqueous acidic environment. We have confirmed for the first time in the art that even with a titanium carbide, nitride or carbonitride layer, hydrogen absorption still occurs in aqueous hydrogen sulfide solutions. Contrary to the general belief, our exhaustive experiments actually showed that such a layer strongly promotes hydrogen absorption by titanium in aqueous hydrogen sulfide solutions.

We ran a number of experiments to study the causes of hydrogen absorption. The detailed mechanism of the hydrogen absorption by titanium in an aqueous hydrogen sulfide solution has not yet been clarified. We studied hydrogen absorption of titanium materials with, and without, a layer of titanium carbide, titanium nitride, or titanium carbonitride present on their surface. The hydrogen absorption results are illustrated by our electrochemical investigations, as represented by polarization curves in FIG. 1 of titanium in aqueous hydrogen sulfide solutions.

FIG. 1 is a polarization curve for a titanium material whose surface layer was removed to the depth of 10 μm and thus completely freed from titanium carbide, titanium nitride, and titanium carbonitride. The titanium material with the surface layer removed displays a smaller current flow during cathodic polarization than that observed for titanium materials having the surface layer. This is unexpected, since titanium materials with a surface layer of titanium carbide, titanium nitride and titanium carbonitride, exhibit excellent corrosion resistance in general applications. Thus, we have found that such titanium materials having the layer are not resistant to corrosion in aqueous hydrogen sulfide solution.

The cathodic reaction on the surface of the titanium material is assumed at this time to be $2H_2S+2e^- \rightarrow H_2+2HS^-$. The small current flow during cathodic polarization appears to imply that less hydrogen gas evolves on titanium, if the surface layer is removed. As a consequence, less hydrogen absorption by titanium can take place.

In brief, it can be said that FIG. 1 indicates that titanium carbide, titanium nitride, and titanium carbonitride present on the titanium serve as active sites, inducing the vigorous reaction $2H_2S+2e\ H \rightarrow H_2+2HS^-$. Thus, we have found that minimizing the amounts of titanium carbide, titanium nitride, and titanium carbonitride present in the titanium surface portion enhances the resistance to hydrogen absorption.

A titanium material can be produced without forming a titanium carbide, titanium nitride, or titanium carbonitride layer on its surface. However, it is not economically feasible to produce a titanium material by a process which avoids formation of such a layer.

The generation of the layer on the titanium surface can be prevented, for example, by omitting rolling oil and reducing the temperature during cold working, and by using a heat treatment temperature of less than 300° C. or above 850° C. Unfortunately, a process using no rolling oil and a lower working temperature necessitates a very extended rolling time period which is accompanied with increased cost. When the heat treatment temperature is less than 300° C., titanium can not be effectively recrystallized within an industrially permissible time period. This results in insufficient elongation of the rolled titanium material and increased cost. Hence, products which satisfy ASTM standards can not be produced. Further, heat treatment temperatures above 850° C. increase the cost. Moreover, when the temperature is raised beyond 850° C., the structure of the titanium material is changed due to its transformation temperature being exceeded. Thus, an equiaxed structure, which is desired by users, is not obtainable with such higher temperatures.

For the above reasons, it is very difficult to efficiently produce a high quality titanium material which is free of a surface layer such as titanium carbide, titanium nitride, or titanium carbonitride.

The present invention provides a convenient way to overcome the effects of corrosion due to an aqueous hydrogen sulfide solution environment. We have discovered that it is advantageous and expedient to efficiently produce a high quality titanium material according to a process such as that of Taki, et al., supra, followed by removing a surface layer. Hence, a titanium material with a titanium carbide, titanium nitride, titanium carbonitride, or a combination thereof is produced by the following general method.

A titanium material is subjected to a cold-working procedure. During 10% or more of the total degree of cold working, an oil is permitted to exist on the surface of the titanium material. The titanium material is then subjected to heat treatment at a temperature of 300° C. to 850° C. The heat treatment is preferably from 550° C. to 700° C. in a vacuum with an inert gas atmosphere. A titanium material is produced with a layer formed on its surface containing at least one of titanium carbide, titanium nitride or titanium carbonitride. For example, pure titanium (e.g. grade 2) is worked to a thickness from 0.5 mm to 0.2 mm by cold-rolling in the presence of a rolling oil and then subjected to heat treatment in an argon atmosphere at 650° C. for about 3 hours.

Factors influencing the formation of the layer on the titanium material surface include rolling speed, amount of rolling oil, product dimensions, etc. The rolling speed of titanium is ordinarily 100 to 300 meters per minute, but even when rolling is performed at an extremely slow speed of 10 meters per minute, or at a high speed of 600 meters per minute, the layer is formed on the titanium material.

After the titanium material is produced which has a titanium carbide, titanium nitride, or titanium carbonitride surface layer, a layer of the surface is removed. Removing the metal from the surface leads to a reduction of the yield and an increase in the manufacturing cost. Therefore the depth of metal removal should be as thin as possible. Further careful study on the depth of removal has made it clear that the beneficial effect upon hydrogen absorption resistance cannot be achieved without removing metal to a depth of at least 0.5 μm from the surface. The deeper the surface metal is removed the more the carbonitride layer, for example, is eliminated and hence the less the hydrogen will be absorbed. Removal down to 20 μm is enough to completely remove a carbonitride layer that has resulted from rolling and annealing. The removal beyond 20 μm leads to lowering of the yield. It is therefore desirable to set the upper limit of the depth of removal to 20 μm. According to this discovery, the present invention provides a method of producing a titanium material having improved resistance to hydrogen absorption in aqueous hydrogen sulfide solutions which comprises removing a layer of at least 0.5 μm, but not greater than 20 μm, depth from the surface of a titanium material that has been annealed after cold rolling for removing titanium carbide, titanium nitride, and titanium carbonitride.

Our investigations have also clarified that even though titanium carbide, titanium nitride, and titanium carbonitride have been removed from the titanium surface, undesired hydrogen absorption can still occur. We have found that any flaw resulting from handling of titanium material becomes an active site through which hydrogen is absorbed. Therefore, it is preferable that the titanium material has no flaw to a depth beyond 10 μm from the surface. For example, the titanium material sheet or tube, after removing a layer from its surface, has no flaw at a depth greater than 10 μm below the surface.

Transporting and handling the titanium material during and after production can produce a surface flaw (for example, a scratch, cut or scrap) on the titanium material. Such surface flaws may be caused, for example, by contact abrasion, scratching or scraping of the titanium material during handling or transportation before the formation of a titanium carbide, titanium nitride, or titanium carbonitride. Thus, prior to utilization of the titanium material, it may be desirable to remove a layer from the surface of the titanium material to remove or minimize such flaw.

Further, when the surface layer is removed from the titanium material, a flaw which had been covered by the surface layer may become exposed. Flaws can also be produced by surface roughness due to grinding processes used to remove the titanium carbide, titanium nitride or titanium carbonitride surface layer.

Figure 2:
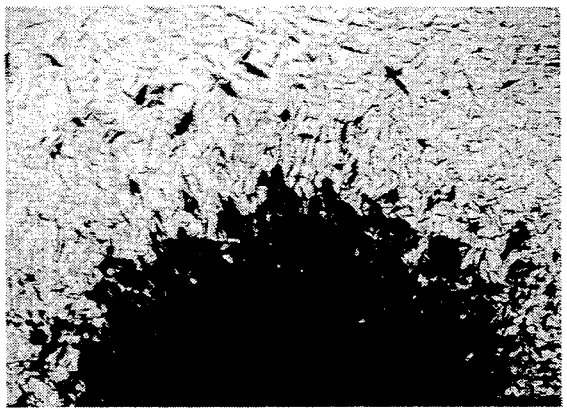
FIG. 2 is a micrograph showing the micro-structure of a cross section of a titanium material where there is a flaw.

Undesired hydrogen absorption by a titanium material which has a surface flaw is illustrated by FIG. 2. The micrograph of FIG. 2 shows the microstructure of a flawed titanium material in a cross section, upon immersion in an aqueous hydrogen sulfide solution. A hydride can be seen spreading radially from the flaw in the center.

It has further been found that, when the titanium surface is ground to remove the titanium carbide, titanium nitride or titanium carbonitride, rough grinding will form an active site that induces hydrogen absorption. Tests revealed that the hydrogen absorption caused by surface roughness can be completely precluded when the surface roughness Rmax after the grinding is 3.0 μm or less. Therefore, it is desirable that the titanium material has a surface roughness Rmax not exceeding 3.0 μm. Polishing of the surface can be utilized to reduce the surface roughness.

Another way of reducing surface roughness is by depositing an oxide film on the surface of the titanium material. Such a film can also serve as a passivation film. An oxide film can be formed on the final surface of the titanium material by heating the titanium material to a temperature of 300° C. to about 850° C. in air or in an oxygen enriched environment. Preferably, the titanium material is heated in air or an oxygen rich environment at a temperature of about 700° C. to about 850° C.

After the heating process to form an oxide layer, the titanium material may be quenched by water cooling. Alternatively, it may be cooled with air. The cooling water is typically at room temperature (around 20° C.) but may be at temperatures up to 80° C. Water cooling cools the titanium material to nearly room temperature typically in about one minute. When air-cooled, the titanium material may be allowed to stand until it is cooled to an ambient temperature. Alternatively, the titanium material may be cooled to ambient temperature by blowing a gas such as air, nitrogen, or argon onto the material. Preferably an external oxide scale layer comprising a porous oxide at the outer most area of the surface composite layer is removed, for example, by quenching.

The thicker the oxide film formed on the titanium material surface, the better the hydrogen absorption resistance of the material. However, an oxide film which is thicker than 500 nm is very brittle. For this reason, it is recommended that the titanium surface has an oxide film ranging in thickness from 15 to 500 nm formed thereon.

EXAMPLES

The effectiveness of the method of the invention will become apparent from the following description made in connection with examples which are set forth merely for illustration.

Example 1

This example was intended to confirm that the presence of a nitride, carbide, or carbonitride in the surface portion of titanium causes vigorous hydrogen absorption by the surface in an aqueous hydrogen sulfide solution. To this end, test specimens were prepared which have a nitride, carbide, or carbonitride formed on the surface by gas nitriding, gas carbonizing, or rolling followed by annealing. To be more specific, one specimen was a titanium sheet the surface of which had been removed 10 μm deep by pickling. The analytical values of the sheet are given in Table 1.

Pieces of the pickled titanium sheet were utilized as a comparative control. Test specimens were produced from the above pickled titanium sheet by heating pieces of the sheet at 900° C. in either nitrogen gas or methane gas. Heating was maintained in the gaseous environment until a layer of titanium nitride or titanium carbide was formed over the entire titanium surface.

Yet another specimen was a piece of titanium sheet on which a carbonitride had been formed in accordance with the procedure described in U.S. Pat. No. 4,908,072. The titanium sheet with a titanium carbonitride layer was formed by decontaminating a pure titanium (Grade 2) 2 mm thickness plate by pickling, followed by cold-working. During 10% of the cold-working a rolling oil was utilized. The cold rolled titanium material was then heat treated at 600° C. for 2 hours.

The titanium material test specimens were each placed in a hermetically closeable container, together with an aqueous hydrogen sulfide solution (which has the composition shown in Table 2 and is sampled from an oil refining plant actually in operation). After a test by heating at 110° C. for 60 days, the hydrogen concentrations of the test specimens were measured. The hydrogen absorption results are given in Table 3.

TABLE 1

| Analytical values of titanium tested (wt %) | | | | |
|---|---|---|---|---|
| O | H | Fe | N | bal. |
| 0.118 | 0.0020 | 0.0030 | 0.004 | Ti |

TABLE 2

| Analysis of aqueous hydrogen sulfide solution (wt %) | | | |
|---|---|---|---|
| $H_2S$ | $NH_3$ | HCN | pH |
| 3.8 | 9.96 | 13.8 | 9.0 |

TABLE 3

| Amounts of hydrogen absorbed | | | | |
|---|---|---|---|---|
| | Hydrogen concentration (ppm) | | | |
| NO | Before test | After test | Amount of hydrogen absorbed | Comment |
| 1 | 22 | 24 | 2 | surface removed |
| 2 | 15 | 75 | 60 | TiN |
| 3 | 16 | 109 | 93 | TiC |
| 4 | 8 | 160 | 142 | TiC, TiN, Ti (CN) |

The titanium material (No. 1) freed from the surface contaminants within the depth defined by the present invention showed a hydrogen concentration of 24 ppm as contrasted with the pre-test value of 22 ppm, indicating that it had taken up only 2 ppm hydrogen. The specimen No. 2 that had titanium nitride formed and No. 3 that had titanium carbide gave hydrogen absorption values of 60 to 70 ppm. The titanium (No. 4) that had been rolled for the formation of a carbonitride showed a clear evidence of hydrogen absorption. Thus, it should be clear that whatever the step in which the nitride, carbide, or carbonitride is formed their presence in the titanium surface portion evidently encourages vigorous hydrogen absorption by titanium in an aqueous hydrogen sulfide solution.

Example 2

Figure 3:
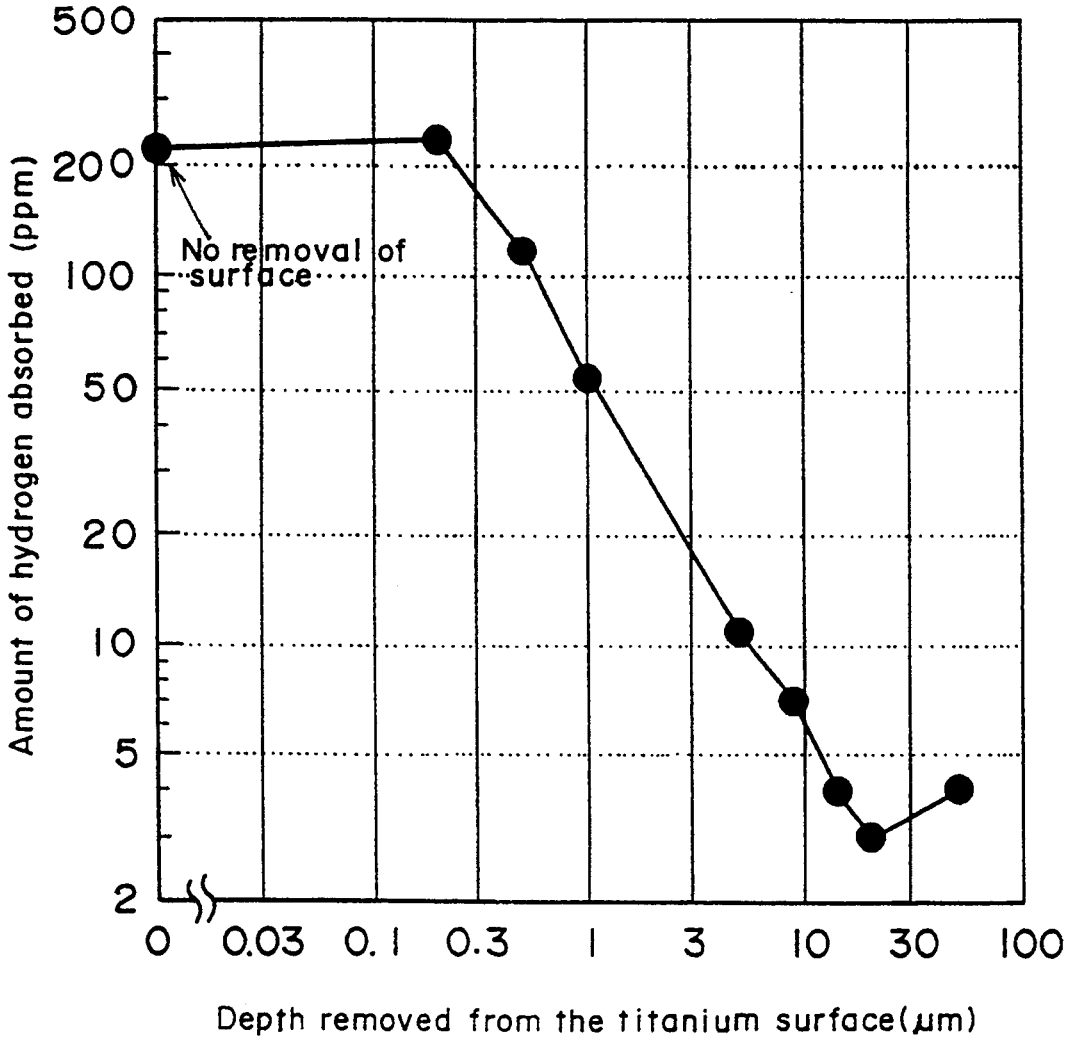
FIG. 3 is a graphic representation of the results of hydrogen absorption tests.

A titanium sheet 0.7 mm in thickness, obtained after 80% cold rolling and subsequent annealing under vacuum at 650° C. for 2 hours, was pickled to varying degrees to give test specimens of different thicknesses. In the same manner as described in Example 1, the specimens were tested by immersion in an aqueous hydrogen sulfide solution, and the amounts of hydrogen they absorbed were measured. In this example, the immersion period was 100 days. The results are shown in FIG. 3.

The test specimen whose surface had been removed less than 0.5 μm deep showed little beneficial effect of resisting hydrogen absorption. The specimens with the removal to the depth of 0.5 μm or more gave clear evidence of hydrogen absorption resistance. Removal beyond the depth of 20 μm gave no noticeable increase in the beneficial effect.

The amount of metal removed, i.e., how many micrometers deep from the surface, was determined by measuring the difference between weights before and after the pickling and calculating the value using the known surface area and density together with the measured value.

Example 3

A 0.7 mm-thick titanium sheet obtained after 80% cold rolling and subsequent vacuum annealing at 650° C. for 2 hours was wet-polished to varying degrees, from the use of #120 abrasive paper to buff polishing, to give test specimens. The specimens were immersed in an aqueous hydrogen sulfide solution for 3700 hours and the changes in their hydrogen concentrations before and after the immersion were measured. The analytical values of the aqueous hydrogen sulfide solution used are given in Table 4. The test specimens' hydrogen absorption results are shown in Table 5. With the test specimens having surface roughness Rmax values of 4.8 and 3.1 μm, very large hydrogen absorption took plate, but when the Rmax values were 1.3, 1.1, and 0.9 μm, the hydrogen absorption was far smaller. This testifies to the necessity of limiting the surface roughness Rmax of titanium to a range of no more than 3.0 μm.

TABLE 4

| Analysis of aqueous hydrogen sulfide solution (wt %) | | | |
|---|---|---|---|
| $H_2S$ | $NH_3$ | HCN | pH |
| 6.2 | 4.03 | 13.8 | 6.0 |

TABLE 5

| Amounts of hydrogen absorbed | | | | | |
|---|---|---|---|---|---|
| | | | Hydrogen concentration (ppm) | | |
| No | Abrasive Paper # | Surface roughness Rmax (μm) | Before test | After test | Amount of hydrogen absorbed |
| 1 | # 120 | 4.8 | 12 | 469 | 457 |
| 2 | # 600 | 3.1 | 12 | 351 | 339 |
| 3 | # 1200 | 1.3 | 12 | 84 | 72 |
| 4 | # 4000 | 1.1 | 12 | 63 | 51 |
| 5 | Buff polishing | 0.9 | 12 | 54 | 42 |

Example 4

A 0.7 mm-thick titanium sheet was prepared by 80% cold rolling and subsequent vacuum annealing at 650° C. for 2 hours. The resulting titanium sheet was pickled to remove the surface to a depth of 10 μm (20 μm for both sides). Test specimens of the sheet were cut to form flaws of varying depths by a cutter blade. Crevices ranging from 2 to 40 μm in depth were cut into the pieces of the sheet to form comparative test specimens. A piece of the sheet, without any cuts from the cutter blade, was utilized as the control specimen, which was free of surface flaws. In the same manner as in Example 3, the specimens were each subjected to an immersion test and inspected to see whether, or not, they had absorbed hydrogen.

The results of the immersion test for the flawed and the control specimens are summarized in Table 6. With slight flaws, hydrogen absorption was none or very little if any. With flaws 10 μm or deeper, the hydride was clearly visible and, as the depth increased, more hydride could be observed. This means that the depth of any flaw in the surface portion of a titanium material must not exceed 10 μm.

TABLE 6

| Degrees of hydrogen absorption observed of flawed titanium material specimens* | | |
|---|---|---|
| No | Depth of Flaw (μm) | Degree of hydrogen absorption |
| 1 | No flaw | No hydride observed. |
| 2 | 2 | Hydride not observed. |
| 3 | 6 | A slight amount of hydride observed around the flaws. |
| 4 | 10 | Some hydride observed around the flaws. |
| 5 | 15 | Much hydride observed around the flaws. |
| 6 | 20 | Much hydride observed around the flaws. |
| 7 | 40 | A very large amount of hydride observed around the flaws. |

TABLE 6-continued

| Degrees of hydrogen absorption observed of flawed titanium material specimens* | | |
|---|---|---|
| No | Depth of Flaw (μm) | Degree of hydrogen absorption |

*The degree of hydride formation was determined through the observation of the cross sectional structure of each flawed test specimen.

Example 5

A 0.7 mm-thick titanium sheet prepared by 80% cold rolling and subsequent vacuum annealing at 650° C. for 2 hours was pickled to remove the surface to a depth of 10 μm (20 μm for both sides). The sheet was heat-treated in the air atmosphere, and test specimens with oxide films of increasing thicknesses formed on the titanium surface were prepared. They were immersion tested in the same way as described in the preceding examples and were inspected for the degrees of hydrogen absorption. The immersion period in this example was 70 days. Table 7 summarizes the results. It can be seen that the specimen having an oxide film 15 nm or thicker is improved in hydrogen absorption resistance over the specimen not subjected to the atmospheric oxidation. The beneficial effect is enhanced as the film thickness increases but is almost saturated in the vicinity of 500 nm. An oxide film thicker than 500 nm is very brittle, and especially in the manufacture of titanium tubing or in the fabrication of a heat exchanger, there is the danger of exfoliation. Hence the upper limit of the thickness of the oxide film is stipulated to 500 nm.

TABLE 7

| Amounts of hydrogen absorbed | | | | |
|---|---|---|---|---|
| | | Hydrogen concentration (ppm) | | |
| No | Thickness of oxide film (nm) | Before test | After test | Amount of hydrogen absorbed |
| 1 | Not oxidized in air | 8 | 36 | 28 |
| 2 | 7 | 8 | 41 | 33 |
| 3 | 15 | 8 | 25 | 17 |
| 4 | 50 | 8 | 22 | 14 |
| 5 | 120 | 8 | 28 | 20 |
| 6 | 420 | 8 | 19 | 11 |
| 7 | 500 | 8 | 28 | 20 |
| 8 | 760 | 8 | 24 | 16 |

All references cited with respect to synthetic, preparative and analytical procedures are incorporated herein by reference.

The present invention may be embodied in other specific forms without departing from the spirit or essential attributes thereof and, accordingly, reference should be made to the appended claims rather than to the examples in the foregoing specification, as indicating the scope of the invention. It is reasonably expected that an ordinary practitioner in this technical area, upon considering the present description and claims, can provide other equivalent forms of the present invention without departing from the spirit or essential attributes thereof. Accordingly, such variations and permutations are intended to be encompassed within the scope and claims of the present invention.

ADVANTAGES OF THE INVENTION

The method of the present invention is based on the unexpected discovery that a corrosion resistant titanium material can be produced by removing a layer of at least 5 μm from its surface. This process affords a titanium material that absorbs very small amounts of hydrogen in aqueous hydrogen sulfide solutions compared with conventional titanium materials. The present invention provides titanium sheets and tubes for desulfurization equipments in an oil refinery plant.

We claim:

1. A method of producing a titanium material having enhanced resistance to hydrogen absorption in an aqueous hydrogen sulfide solution, comprising the steps of:

i) subjecting a titanium material to cold working with the use of a working oil, with the degree of the cold working being 10% or more of the total cold reduction, to produce a cold-worked titanium material;

ii) heat treating the cold-worked titanium material at a temperature of from 300° C. to 850° C. in vacuum or in an inert gas atmosphere to produce a titanium material with a layer of at least one of titanium nitride, titanium carbide and titanium carbonitride formed on the surface thereof; and iii) removing said surface layer to a depth of at least 0.5 μm so that titanium nitride, titanium carbide and titanium carbonitride formed on the titanium material surface is at least partly removed, thereby imparting enhanced resistance to hydrogen absorption in aqueous hydrogen sulfide solutions to said titanium material.

2. A method according to claim 1 further comprising removing any surface flaws exposed on the titanium material after removing said at least 5 μm depth from the surface of said material, so that the titanium material has no flaws whose depth from the surface is beyond 10 μm.

3. A method according to claim 1 comprising the further step of polishing the titanium material surface after removing said at least 5 μm depth surface layer from said titanium material, so that said titanium material has a surface roughness Rmax not exceeding 3.0 μm.

4. A method according to claim 2, comprising the further step of polishing the titanium material surface after said removing of at least 5 μm depth from the surface of said titanium material, so that said titanium material has a surface roughness Rmax not exceeding 3.0 μm.

5. The method of claim 1 further comprising forming on the surface finally produced on said titanium material a passivation oxide film having a thickness ranging from 15 to 500 nm.

6. The method of claim 2 further comprising forming on the surface finally produced on said titanium material a passivation oxide film having a thickness ranging from 15 to 500 nm.

7. The method of claim 3 further comprising forming on the surface finally produced on said titanium material a passivation oxide film having a thickness ranging from 15 to 500 nm.

8. The method of claim 4 further comprising forming on the surface finally produced on said titanium material a passivation oxide film having a thickness ranging from 15 to 500 nm.

* * * * *